US008777572B2

(12) United States Patent
Cheong et al.

(10) Patent No.: US 8,777,572 B2
(45) Date of Patent: Jul. 15, 2014

(54) ROTOR BLADE

(75) Inventors: Bryan Chee Yuen Cheong, Hartford, CT (US); Stephen C Diamond, Derby (GB); Gurmukh S Sehra, Walsall (GB)

(73) Assignee: Rolls-Royce PLC, London (GB)

( * ) Notice: Subject to any disclaimer, the term of this patent is extended or adjusted under 35 U.S.C. 154(b) by 429 days.

(21) Appl. No.: 13/346,158

(22) Filed: Jan. 9, 2012

(65) Prior Publication Data

US 2012/0189458 A1 Jul. 26, 2012

(30) Foreign Application Priority Data

Jan. 20, 2011 (GB) ..... 1100957.8

(51) Int. Cl.
*F01D 5/08* (2006.01)
*F01D 5/18* (2006.01)
*F01D 5/20* (2006.01)

(52) U.S. Cl.
CPC ..... *F01D 5/20* (2013.01)
USPC ..... 416/97 R; 416/96 R; 416/96 A; 416/228; 416/235; 415/115; 415/173.4

(58) Field of Classification Search
USPC ..... 415/115, 116, 173.1, 173.4; 416/92, 416/96 R, 96 A, 97 R, 228, 235
See application file for complete search history.

(56) References Cited

U.S. PATENT DOCUMENTS 6,790,005 B2 * 9/2004 Lee et al. ..... 416/97 R
7,281,894 B2 * 10/2007 Lee et al. ..... 416/92
7,290,986 B2 * 11/2007 Stegemiller et al. ..... 416/92
7,351,035 B2 * 4/2008 Deschamps et al. ..... 416/92
7,686,578 B2 * 3/2010 Klasing et al. ..... 415/173.1
7,972,115 B2 * 7/2011 Potier ..... 416/228
8,092,178 B2 * 1/2012 Marini et al. ..... 416/97 R
8,425,183 B2 * 4/2013 Lee et al. ..... 415/173.1
8,512,003 B2 * 8/2013 Klasing et al. ..... 416/228
8,632,311 B2 * 1/2014 Klasing et al. ..... 416/228

(Continued)

FOREIGN PATENT DOCUMENTS

EP 1541806 A2 6/2005
FR 2891003 A1 3/2007
GB 2462131 A 1/2010

OTHER PUBLICATIONS

British Search Report dated Apr. 28, 2011 issued in British Application No. GB 1100957.8.

(Continued)

*Primary Examiner* — Igor Kershteyn
(74) *Attorney, Agent, or Firm* — Oliff PLC

(57) ABSTRACT

A rotor blade has a radially extending aerofoil body having pressure and suction sides. The rotor blade further has squealer tip. The squealer tip includes a peripheral wall surrounding a cavity which is open at the radially outward end of the blade and at the trailing edge of the aerofoil body. The peripheral wall has at least one first region which extends radially from the aerofoil surface which has a first outer surface. The peripheral wall further has, along at least part of at least one of the pressure and suction sides, at least one second region inclined outwardly of the cavity with respect to the radial direction of the blade which has a second outer surface which extends obliquely outwardly of the blade. A radially outer portion of the second outer surface turns towards the radial direction to truncate the outward extension of the second outer surface.

13 Claims, 3 Drawing Sheets

(b)

(56) References Cited

U.S. PATENT DOCUMENTS

| | | | |
|---|---|---|---|
| 2004/0126236 | A1 | 7/2004 | Lee et al. |
| 2006/0051209 | A1 | 3/2006 | Lee et al. |
| 2010/0098554 | A1 | 4/2010 | Cheong et al. |

OTHER PUBLICATIONS

Apr. 2, 2012 European Search Report issued in European Patent Application No. EP 12 15 0445.

* cited by examiner (a)

(b)

(c)

ROTOR BLADE

CROSS-REFERENCE TO RELATED APPLICATIONS

This application is based upon and claims the benefit of priority from British Patent Application Number 1100957.8 filed 20 Jan. 2011, the entire contents of which are incorporated by reference.

BACKGROUND OF THE INVENTION

1. Field of the Invention

The present invention relates to a blade for a rotor, and is particularly, although not exclusively, concerned with a blade such as a turbine blade for a rotor to be used in a gas turbine engine.

2. Description of the Related Art

With reference to FIG. 1, a ducted fan gas turbine engine generally indicated at 110 has a principal and rotational axis X-X. The engine comprises, in axial flow series, an air intake 111, a propulsive fan 112, an intermediate pressure compressor 113, a high-pressure compressor 114, combustion equipment 115, a high-pressure turbine 116, and intermediate pressure turbine 117, a low-pressure turbine 118 and a core engine exhaust nozzle 119. A nacelle 121 generally surrounds the engine 110 and defines the intake 111, a bypass duct 122 and a bypass exhaust nozzle 123.

The gas turbine engine 110 works in a conventional manner so that air entering the intake 111 is accelerated by the fan 112 to produce two air flows: a first air flow A into the intermediate pressure compressor 113 and a second air flow B which passes through the bypass duct 122 to provide propulsive thrust. The intermediate pressure compressor 113 compresses the air flow A directed into it before delivering that air to the high pressure compressor 114 where further compression takes place.

The compressed air exhausted from the high-pressure compressor 114 is directed into the combustion equipment 115 where it is mixed with fuel and the mixture combusted. The resultant hot combustion products then expand through, and thereby drive the high, intermediate and low-pressure turbines 116, 117, 118 before being exhausted through the nozzle 119 to provide additional propulsive thrust. The high, intermediate and low-pressure turbines respectively drive the high and intermediate pressure compressors 114, 113 and the fan 112 by suitable interconnecting shafts.

GB 2462131 discloses a turbine rotor blade for use in e.g. the high-pressure turbine of such an engine. The blade has, at its radially outer end, a cavity or passage defined by a peripheral wall which has an opening at the trailing edge of the blade. The function of the cavity is to trap gas which leaks past the peripheral wall on the pressure side of the blade. The trapped gas forms a vortex within the cavity, and flows from the cavity through the opening at the trailing edge. This configuration serves to reduce losses in efficiency caused by gas leakage over the turbine blade tips and also to reduce losses caused by flow disturbances set up by the leakage flow.

Such configurations at the tip of a rotor blade are sometimes referred to as "squealer tips".

The blade from GB 2462131 shown in FIGS. 2 and 3 has an aerofoil surface made up of a pressure side 2 and a suction side 4, both extending from a leading edge 6 to a trailing edge 8. The radial tip of the blade is formed as a squealer tip, comprising a partition 10 and a peripheral wall 14, which define a cavity 12. The cavity 12 is open at the radial tip of the blade, and, through an opening 16 at the trailing edge 8 of the blade.

The peripheral wall 14 comprises a first region 18 which extends from the trailing edge 8 over the suction surface 4, round the leading edge 6 and part of the way along the pressure surface 2. This first region 18 extends generally radially, and its outer surface 20 is a smooth continuation of the profile of the aerofoil surface, both on the pressure side 2 and the suction side 4.

The peripheral wall 14 also has a second region 22 which is in the form of a winglet extending generally over the rear (i.e. nearer the trailing edge 8) portion of the pressure side of the blade tip. This second region 22, as is clear from sections S4 and S5 in FIG. 3, inclines outwardly of the cavity 12 with respect to the radial direction. The outer surface of the winglet is thus also inclined to the pressure side of the aerofoil surface. Between the first region 18 and the second region or winglet 22, there is a transition region 26, shown in sections S2 and S3 in FIG. 3. In the transition region 26, the peripheral wall 14 has two portions, namely a first portion 28 which extends radially, like the first region 18, and a second portion 30, which is inclined, like the second region or winglet 22. Thus, as the transition region 26 extends away from the leading edge 6, the second portion 30 becomes larger, to merge with the second region 22, while the first portion 28 becomes smaller.

Because the winglet 22 is inclined from the radial direction, it has the effect of widening the cavity 12 as it approaches the trailing edge 8. The result is that, in use of the blade, gas leaking over the peripheral wall 14 on the pressure side 2 will, over the full extent of the pressure side 2, encounter a region of the cavity 12 having a width which is sufficiently large to enable the overflowing air to reattach within the cavity 12 and so remain captured until it is discharged through the opening 16 at the trailing edge 8.

As described in GB 2462131, such winglets may also be formed on the suction side of the blade tip.

OBJECTS AND SUMMARY OF THE INVENTION

There is a need for further improvements to blades having squealer tips.

A first aspect of the present invention provides a blade for a rotor, the blade having:

a radially extending aerofoil body which provides an aerofoil surface having pressure and suction sides extending between a leading edge and a trailing edge of the aerofoil body, and a squealer tip at the radially outward end of the aerofoil body, the squealer tip comprising a peripheral wall surrounding a cavity which is open at the radially outward end of the blade and at the trailing edge of the aerofoil body;

the peripheral wall having:

at least one first region which extends radially from the aerofoil surface and which has a first outer surface which is a continuation of the aerofoil surface, and along at least part of at least one of the pressure side and the suction side, at least one second region which is inclined outwardly of the cavity with respect to the radial direction of the blade and which has a second outer surface which extends obliquely outwardly of the blade from the aerofoil surface;

wherein a radially outer portion of the second outer surface turns towards the radial direction to truncate the outward extension of the second outer surface.

Advantageously, by truncating the outward extension in this way, it is possible to preserve the beneficial aerothermal and cooling performance of the squealer tip, while significantly reducing the blade tip mass, and therefore reducing the mechanical stresses in the root region of the blade and the load on rim of the rotor disc which, in use, carries the blade. In addition, the reduced mass can decrease the amount of deflection at the blade tip.

Truncating the outward extension provides the advantage of reducing (or substantially eliminating) the degradation/wear (for example through oxidation) of the corner of the blade formed by the radially outer portion of the second outer surface and the outermost radial surface of the blade. This may be a result of reducing the distance between this portion (or corner) of the blade and the cooling circuit (for example cooling passages formed within the blade) and/or a result of reducing the surface area of this region of the blade that is exposed to the working fluid, which may be hot combustion gasses. Reducing the degradation (for example through reduced oxidation) of this part of the blade may help to ensure consistent performance of the blade over time, for example though more consistent tip sealing.

The blade may have any one or, to the extent that they are compatible, any combination of the following optional features.

The second outer surface can have a radially inner portion which, on sections which contain the radial direction and are perpendicular to the camber line of the aerofoil body at its radially outward end, is inclined at a first angle relative to the radial direction. Further, the radially outer portion, on these sections, can be inclined at a second angle relative to the radial direction, the second angle being less than the first angle to truncate the outward extension of the second outer surface. For example, the second angle can be at least 5° less than the first angle or preferably at least 15° less than the first angle. The second angle can be at most 45° less than the first angle or preferably at most 25° less than the first angle.

The second region, or at least one of the second regions, may form a pressure side winglet extending along part of the pressure side. For example, the leading end of the pressure side winglet may be positioned approximately 20% of the chordwise distance from the leading edge. The trailing end of the pressure side winglet may be positioned approximately at the trailing edge.

The second region, or at least one of the second regions, may form a suction side winglet extending along part of the suction side. For example, the leading end of the suction side winglet may be positioned approximately 40% of the chordwise distance from the leading edge. The trailing end of the suction side winglet may be positioned approximately at the trailing edge.

Typically, the or each first region of the peripheral wall and the or each second region of the peripheral wall terminate at their radially outer ends in end surfaces which lie in a common plane or at a common radial height. The end surface of the or each second region can then vary in circumferential width along the length of the second region. The peripheral wall can have an inner surface including at least one radially inner portion and adjacent radially outer portion, the outer portion of the inner surface inclining outwardly more than the inner portion of the inner surface to reduce the circumferential width of the end surface. In this way, the blade tip mass can be further reduced, but again without compromising the aerothermal and cooling performance of the squealer tip. For example, the radially inner portion of the inner surface, on sections which contain the radial direction and are perpendicular to the camber line of the aerofoil body at its radially outward end, may be inclined at a third angle relative to the radial direction, and the radially outer portion of the inner surface, on these sections, may be inclined at a fourth angle relative to the radial direction, the fourth angle producing a greater outward inclination of the inner surface than the third angle to reduce the circumferential width of the end surface. The fourth angle can produce an at least 5° greater outward inclination or preferably an at least 15° greater outward inclination. The fourth angle can produce an at most 45° greater outward inclination or preferably an at most 25° greater outward inclination.

The ratio of the width to the depth of the cavity may be not less than 0.5 and preferably not less than 1. The ratio may be not more than 5.

A second aspect of the present invention provides a rotor having one or more blades according to the first aspect.

A third aspect of the present invention provides a gas turbine engine having a rotor according to the second aspect.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS

Figure 1:
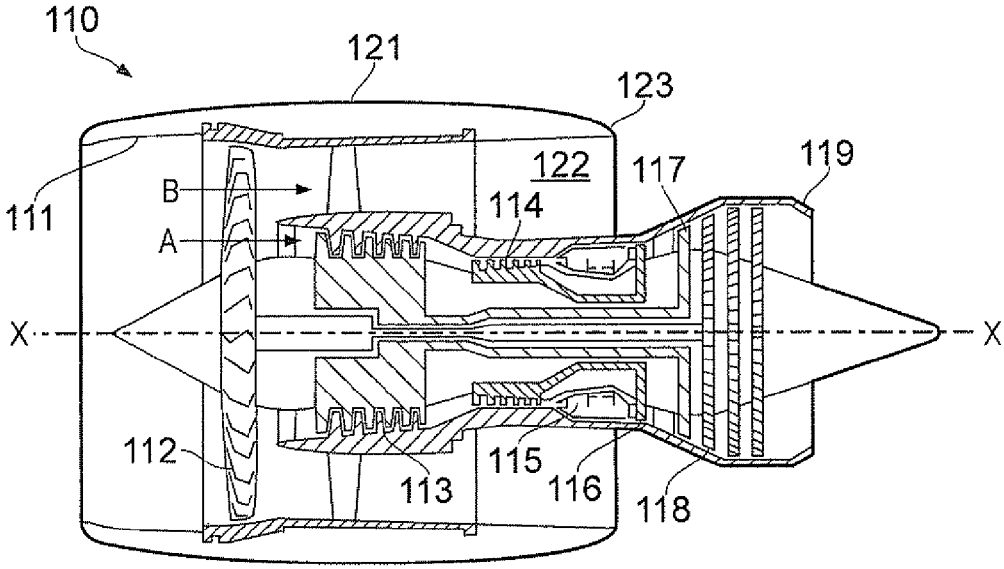
FIG. 1 shows a longitudinal section through a ducted fan gas turbine engine.
Figure 2:
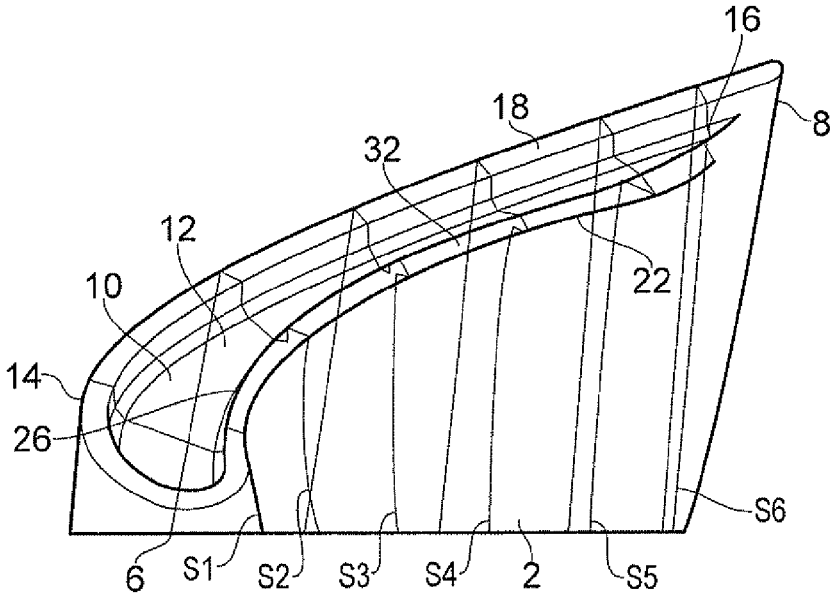
FIG. 2 shows the radially outer tip region of a turbine blade forming part of a turbine rotor of a gas turbine engine.
Figure 3:
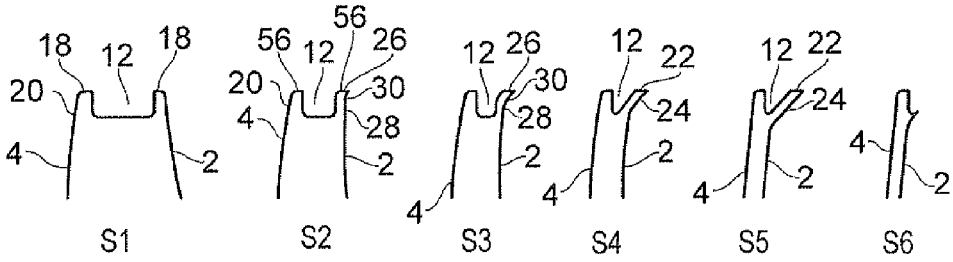
FIG. 3 shows sections S1-S6 shown in FIG. 2.
Figure 4:
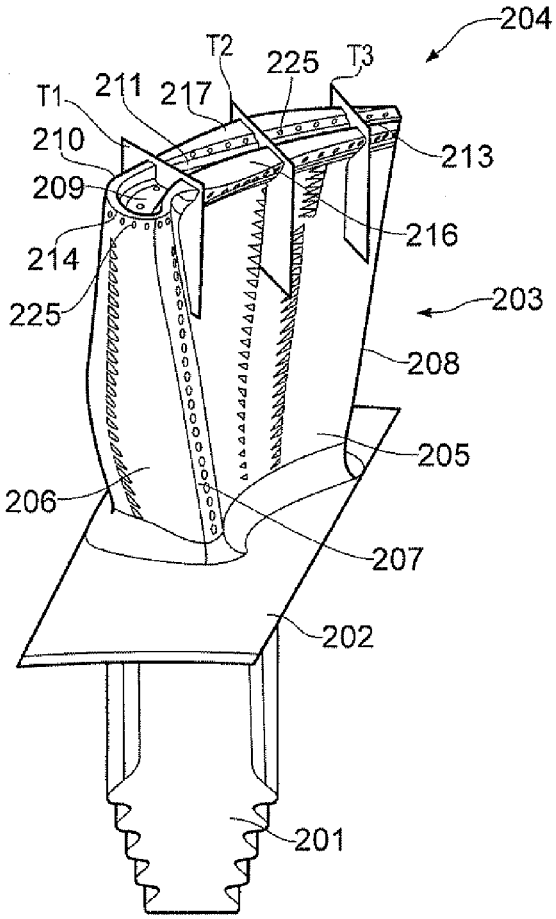
FIG. 4 shows a turbine blade forming part of a turbine rotor of a gas turbine engine.

FIG. 4 shows a turbine blade forming part of a turbine rotor of a gas turbine engine. The blade has, in radially inner to outer sequence, a fir tree formation 201 at the base for fixing the blade to a rotor disc, a platform 202, an aerofoil body 203, and a squealer tip 204. The aerofoil body provides an aerofoil surface having pressure 205 and suction 206 sides extending between a leading edge 207 and a trailing edge 208 of the aerofoil body.

The squealer tip has a partition wall 209 and a peripheral wall 210 which define a cavity 211. The cavity opens radially outwardly, and also opens through an aperture 213 at the trailing edge 208 of the blade. Typically, the ratio of the width to the depth of the cavity is not less than 0.5 and not more than 5.

The peripheral wall 210 comprises a first region 214 which wraps around the leading edge 207 to extend part way over the pressure side 205 to about 20% of the chordwise distance from the leading edge and partway over the suction side 206 to about 40% of the chordwise distance from the leading edge. The first region extends generally radially with an outer surface which is a smooth continuation of the profile of the pressure and suction sides of the aerofoil surface.

The peripheral wall 210 has one pressure side second region 216 which inclines outwardly from the cavity 211 in the form of a winglet extending generally over the pressure side 205 from about 20% of the chordwise distance from the leading edge 207 to the trailing edge 208. The peripheral wall also has a suction side second region 217 which inclines outwardly from the cavity 211 in the form of a winglet extending generally over the suction side 206 from about 40% of the chordwise distance from the leading edge to the trailing edge.

FIG. 4 also shows successive sections T1 to T3 which each contain the radial direction and are perpendicular to the camber line of the aerofoil body at its radially outward end. As is clear from sections T1 to T3 respectively shown in FIGS. 5(*a*) to (*c*), these second regions 216, 217 have outer surfaces which extend obliquely outwardly of the blade from the aerofoil surface. In particular, on the respective section, the radially inner portion 218 of each of these outer surfaces is inclined at a first angle $\alpha_1$ relative to the radial direction, and the radially outer portion 219 of each of the outer surfaces is inclined at a second angle $\alpha_2$ relative to the radial direction. The second angle is less than the first angle, which truncates the outward extension of the respective outer surface. Thus, in transitioning from its radially inner to its radially outer portion, each outer surface turns towards the radial direction to truncate its outward extension. Typically, the second angle is less than the first angle by a value in the range from 5° to 45°.

Figure 5:
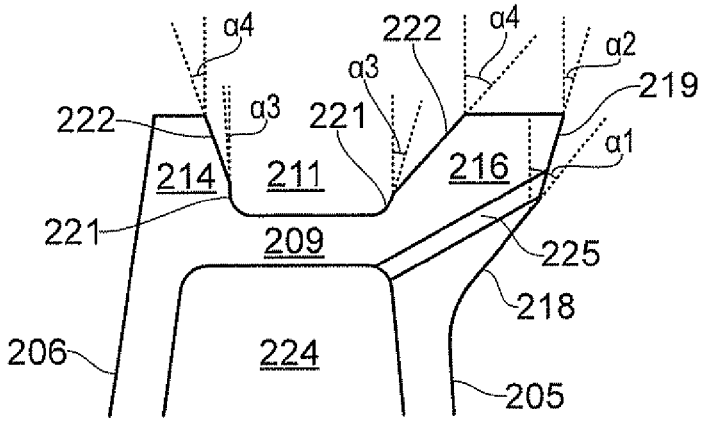
FIGS. 5(*a*) to (*c*) show respectively sections T1, T2 and T3 shown in FIG. 4.
Figure 5:
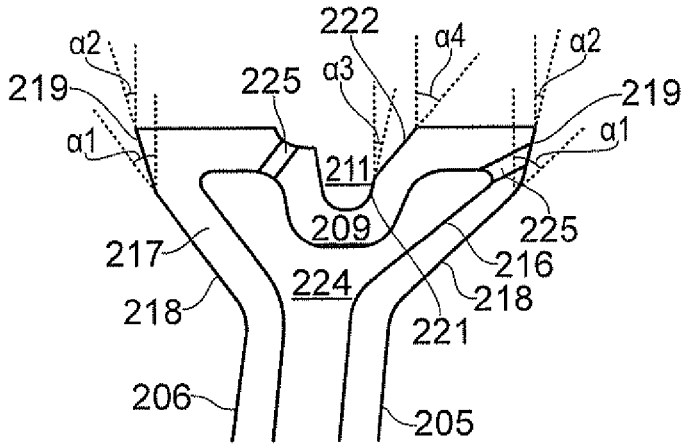
Figure 5:
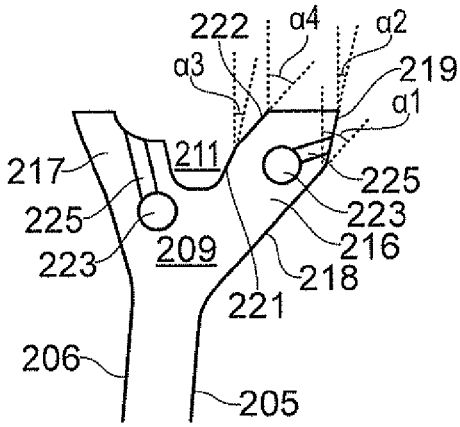

As illustrated in section T2 shown in FIG. 5(*b*), on a given section the outward extensions of the outer surfaces of both second regions 216, 217 can be truncated. Alternatively, as illustrated in sections T1 and T3 shown in FIGS. 5(*a*) and (*c*), on a given section the outward extension of the outer surface of only one of the second regions (in these cases, the pressure side second region 216) can be truncated.

The truncation of the outward extensions of the wing let outer surfaces reduces the mass of the squealer tip, which, in use, decreases the mechanical stresses in the root region of the blade and the loading on the rotor disc, and decreases the deflection of the tip of the blade. However, advantageously, the mass reduction is not significantly detrimental to the aerothermal and cooling performance of the squealer tip.

The radially outer ends of the first 214 and the second 216, 217 regions of the peripheral wall 210 lie in a common plane to form end surface of the blade. The circumferential width of this end surface varies along the length of each second region as required to reduce leakage over the blade tip and to accommodate internal cooling features (discussed below).

As illustrated in sections T1 to T3 shown in FIGS. 5(*a*) to (*c*), to further reduce the mass of the squealer tip, the inner surface of the peripheral wall can include a radially inner portion 221 and an adjacent radially outer portion 222 which inclines outwardly more than the inner portion 221 to reduce the circumferential width of the end surface. These portions can be applied to the first region 214 or the second regions 216, 217 of the peripheral wall 210. On the respective section, the inner portion 221 is inclined at a third angle $\alpha_3$ relative to the radial direction, the outer portion 222 is inclined at a fourth angle $\alpha_4$ relative to the radial direction. The fourth angle produces a greater outward inclination of the inner surface than the third angle (e.g. the outward inclination may be from 5° to 45° greater) to reduce the circumferential width of the end surface.

As illustrated in sections T1 and T2 shown in FIGS. 5(*a*) and (*b*), the second regions 216, 217 of the peripheral wall 210 contain extensions of chamber 224, which is part of the primary cooling circuit of the blade. As such, the cooling circuit, for example in the form of cooling passages, may extend into one or more of the one or more second regions 216 217. Thus, the cooling passages may extend to the extremity of the blade, or at least close to the extremity of the blade i.e. to the corner (or close to the corner) formed by radially outer tip of the blade and the radially outer portion 219 of the outer surface of the or each second region 216, 217. In this way, this extremity of the blade can be cooled more effectively, thereby further helping to reduce or substantially eliminate degradation of this area of the blade, for example by reducing oxidation. As mentioned herein, truncating the outward extension of the outer surface of the second region(s) 216, 217 may help to reduce the oxidation of this corner point/region of the blade. The chamber extension 224 may still further reduce this oxidation, for example by effectively moving this corner of the blade still closer to the cooling passages, and thus improving the cooling.

The extensions 224 may feed external surface cooling holes 225 in the inner and outer surfaces of the peripheral wall. As illustrated in section T3 shown in FIG. 5(*c*), towards the trailing edge 208 of the blade, the extensions may elongate into internal cooling passages 223 which also feed cooling air to external surface cooling holes 225.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

We claim:

1. A blade for a rotor, the blade having:

a radially extending aerofoil body which provides an aerofoil surface having pressure and suction sides extending between a leading edge and a trailing edge of the aerofoil body, and a squealer tip at a radially outward end of the aerofoil body, the squealer tip comprising a peripheral wall surrounding a cavity which is open at the radially outward end of the blade and at the trailing edge of the aerofoil body;

the peripheral wall having:

at least one first region which extends radially from the aerofoil surface and which has a first outer surface which is a continuation of the aerofoil surface, and along at least part of at least one of the pressure side and the suction side, at least one second region which is inclined outwardly of the cavity with respect to the radial direction of the blade and which has a second outer surface which extends obliquely outwardly of the blade from the aerofoil surface;

wherein a radially outer portion of the second outer surface turns towards the radial direction to truncate the outward extension of the second outer surface.

2. A blade according to claim 1, wherein:

the second outer surface has a radially inner portion which, on sections which contain the radial direction and are perpendicular to the camber line of the aerofoil body at its radially outward end, is inclined at a first angle relative to the radial direction, and the radially outer portion, on said sections, is inclined at a second angle relative to the radial direction, the second angle being less than the first angle to truncate the outward extension of the second outer surface.

3. A blade according to claim 2, wherein the second angle is less than the first angle by a value in the range from 5° to 45°.

4. A blade according to claim 1, wherein the second region, or at least one of the second regions, forms a pressure side winglet extending along part of the pressure side.

5. A blade according to claim 1, wherein the second region, or at least one of the second regions, forms a suction side winglet extending along part of the suction side.

6. A blade according to claim 1, wherein the or each first region of the peripheral wall and the or each second region of the peripheral wall terminate at their radially outer ends in end surfaces which lie in a common plane or at a common radial height.

7. A blade according to claim 6, wherein the end surface of the or each second region varies in circumferential width along the length of the second region.

8. A blade according to claim 6, wherein the peripheral wall has an inner surface including at least one radially inner portion and adjacent radially outer portion, the outer portion of the inner surface inclining outwardly more than the inner portion of the inner surface to reduce the circumferential width of the end surface.

9. A blade according to claim 8, wherein the radially inner portion of the inner surface, on sections which contain the radial direction and are perpendicular to the camber line of the aerofoil body at its radially outward end, is inclined at a third angle relative to the radial direction, and the radially outer portion of the inner surface, on said sections, is inclined at a fourth angle relative to the radial direction, the fourth angle producing a greater outward inclination of the inner surface than the third angle to reduce the circumferential width of the end surface.

10. A blade according to claim 9, wherein the fourth angle produces an outward inclination which is from 5° to 45° greater than the inclination of the third angle.

11. A blade according to claim 1, wherein the ratio of the width to the depth of the cavity is not less than 0.5 and not more than 5.

12. A rotor having one or more blades according to claim 1.

13. A gas turbine engine having a rotor according to claim 12.

* * * * *